US007578256B2

(12) United States Patent
Daley

(10) Patent No.: US 7,578,256 B2
(45) Date of Patent: Aug. 25, 2009

(54) BOOKMARK

(76) Inventor: Matthew Daley, 231 E. Yale St., Orlando, FL (US) 32804

( * ) Notice: Subject to any disclaimer, the term of this patent is extended or adjusted under 35 U.S.C. 154(b) by 95 days.

(21) Appl. No.: 11/782,179

(22) Filed: Jul. 24, 2007

(65) Prior Publication Data

US 2008/0011220 A1 Jan. 17, 2008

Related U.S. Application Data

(63) Continuation-in-part of application No. 11/293,437, filed on Dec. 2, 2005, now abandoned.

(60) Provisional application No. 60/633,411, filed on Dec. 3, 2004.

(51) Int. Cl.
*B65D 65/28* (2006.01)

(52) U.S. Cl. ..... 116/234; 116/235; 383/209

(58) Field of Classification Search ..... 116/234–240; D19/34; 206/466; 229/87.05, 87.5; 383/209, 383/67

See application file for complete search history.

(56) References Cited

U.S. PATENT DOCUMENTS 1,420,265 A * 6/1922 Kieckhefer ..... 116/235
1,827,636 A * 10/1931 Ames ..... 229/123.2
D89,073 S * 1/1933 Royle ..... D19/34
2,300,216 A * 10/1942 Grodsky et al. ..... 116/237
3,186,628 A * 6/1965 Rohde ..... 383/209
4,011,985 A * 3/1977 Simson ..... 229/68.1
4,203,516 A 5/1980 Stonoga et al.
4,448,310 A 5/1984 Hodgson
4,465,232 A 8/1984 Field
4,492,306 A 1/1985 Cooper et al.
4,681,228 A 7/1987 Kerry et al.
4,747,782 A 5/1988 Campbell, Jr.
4,786,190 A 11/1988 Van Erden et al.
4,795,048 A 1/1989 Trussardi
4,903,841 A * 2/1990 Ohsima et al. ..... 383/200
4,951,404 A 8/1990 Lithwick
5,009,894 A 4/1991 Hsiao
5,088,770 A * 2/1992 McCrea ..... 283/105
5,096,058 A 3/1992 Jurvavin et al.
5,168,988 A * 12/1992 Johnnston ..... 206/0.81
5,248,537 A 9/1993 Giannavola
5,249,546 A 10/1993 Pennelle
5,311,835 A * 5/1994 Knowles ..... 116/235
5,341,930 A * 8/1994 Counts et al. ..... 206/459.5
5,377,612 A * 1/1995 Catalano et al. ..... 116/234
5,382,053 A * 1/1995 Tanaka ..... 281/42
5,462,006 A 10/1995 Thiruppathi (Continued)

*Primary Examiner*—R. A. Smith
*Assistant Examiner*—Tania C Courson
(74) *Attorney, Agent, or Firm*—Robert L. Wolter, Esq.; Cian G. O'Brien, Esq.; Beusse Wolter Sanks Mora & Maire, P.A.

(57) ABSTRACT

A bookmark has a compartment for storing an article for use by a reader. The bookmark preferably comprises a pouch that is capable of being placed between pages of a book, and a tab that protrudes from a periphery of a book or pages of a book. The pouch holds an article in the compartment, which can be opened to access and retrieve the article. In addition, the tab or pouch may contain data entry fields for inputting data relative to the book and person reading the book. Indicia may also be disposed on a surface of the tab.

15 Claims, 2 Drawing Sheets

U.S. PATENT DOCUMENTS

| | | | | |
|---|---|---|---|---|
| 5,535,885 | A | 7/1996 | Daniel et al. | |
| 5,632,225 | A * | 5/1997 | Krasner | 116/235 |
| 5,715,849 | A | 2/1998 | Vanbraekel | |
| 6,109,205 | A * | 8/2000 | Smith | 116/234 |
| 6,287,652 | B2 | 9/2001 | Speckhals et al. | |
| 6,355,285 | B1 | 3/2002 | Hoy | |
| D455,781 | S | 4/2002 | Jobelius et al. | |
| 6,390,015 | B1 | 5/2002 | Germano | |
| 6,446,803 | B1 | 9/2002 | McKinney | |
| 6,481,367 | B2 | 11/2002 | McClosky | |
| D477,360 | S * | 7/2003 | Larkins et al. | D19/26 |
| 6,685,226 | B2 | 2/2004 | McKinney et al. | |
| 6,722,309 | B1 | 4/2004 | Ben-Dor et al. | |
| 6,929,128 | B2 | 8/2005 | Caldwell et al. | |
| 7,461,613 | B2 * | 12/2008 | Sinclair et al. | 116/234 |
| 2001/0013698 | A1 | 8/2001 | Soussan | |
| 2003/0217687 | A1 * | 11/2003 | Segall | 116/234 |
| 2006/0144316 | A1 * | 7/2006 | Johnson | 116/234 |
| 2008/0273821 | A1 * | 11/2008 | Doll | 383/209 |
| 2009/0101061 | A1 * | 4/2009 | Almodovar | 116/235 |

* cited by examiner

BOOKMARK

CROSS-REFERENCE TO RELATED APPLICATIONS

This application is a continuation-in-part of U.S. application Ser. No. 11/293,437 filed Dec. 2, 2005, now abandoned which claims the benefit of the U.S. Provisional Application No. 60/633,411, filed Dec. 3, 2004.

BACKGROUND OF THE INVENTION

This invention relates in general to bookmarks. More particularly, the invention pertains to bookmarks that have been adapted to provide multiple purposes beyond serving as a mark for a page in a book, magazine, journal or the like.

Bookmarks primarily serve the singular purpose of marking the page or pages for a person reading a book, magazine, journal or the like. However, the bookmark may take the form of various shapes and sizes, or contain varying artwork or words for a user's enjoyment. Primarily bookmarks have a first portion that is inserted between pages of a book, and a second portion connected to the first portion that extends beyond a periphery of the pages of the book. With such a configuration, when a person stops reading a book, the reader places the bookmark in a desired position on the page being read and closes the book. Having the second portion protruding beyond the periphery of the book enables the reader to readily locate the page on which the person stopped reading.

Ben-Dor et al., in U.S. Pat. No. 6,722,309, discloses a bookmark that may serve another purpose other than simply marking a page in a book. The bookmark has an upper hook-like section that rides over the binding of a book, and acts as an "attention-attracting" item, such as pencil sharpener, photograph or advertising piece, which may be attached to the hook-like section. The '309 patent also mentions that the bookmark itself may be formed of a suitable candy substance. Accordingly, the use of the bookmark as a candy substance raises sanitary issues.

BRIEF DESCRIPTION OF THE INVENTION

The present invention is for a bookmark has a limited first lifecycle for use as a bookmark, and when a book is completed the bookmark is retained as a keepsake containing information relative to a reader and/or a book having been read by a user. To that end, the present invention is for a bookmark having a compartment for storing an article for use by a reader, the article being placed in the pouch by the manufacturer of the bookmark. The bookmark preferably comprises a lower pouch having a sealed top end and a sealed bottom end. A tab is affixed to the top end of the pouch so that a portion of the pouch may be inserted between pages of a book, wherein at least a portion of the tab protrudes from a periphery of a book, or pages of a book, to serve as a book mark. The compartment of the pouch holds the article, and the compartment can be opened to access and retrieve the article. In an embodiment the bottom end of the pouch is detachable from a remaining portion to open the pouch and compartment. In addition, the tab or pouch may contain data entry for inputting data relative to the book and person reading the book. The tab may also have fanciful indicia that may be relevant to the book, the article in the pouch or relevant to a reader's likenesses.

The invention is ideally suited for children, but not limited to use by children. The invention provides a reward for a child reader upon completion of a book. Once a child finishes reading a book a bottom end of the pouch is detached from a remaining portion of the pouch to retrieve the article. In addition, the child and/or parent of the child, may record on the bookmark the name of the child, the title of the book and the date the child completed reading the book. The bookmark of the present invention also provides a sanitary delivery system in the case the article is an edible insert used with the bookmark.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE INVENTION

Figure 1:
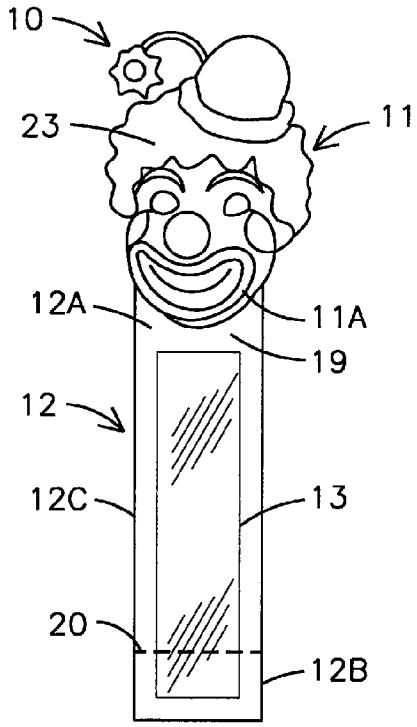
FIG. 1 is a front elevational view of an embodiment of the bookmark according to the present invention.
Figure 2:
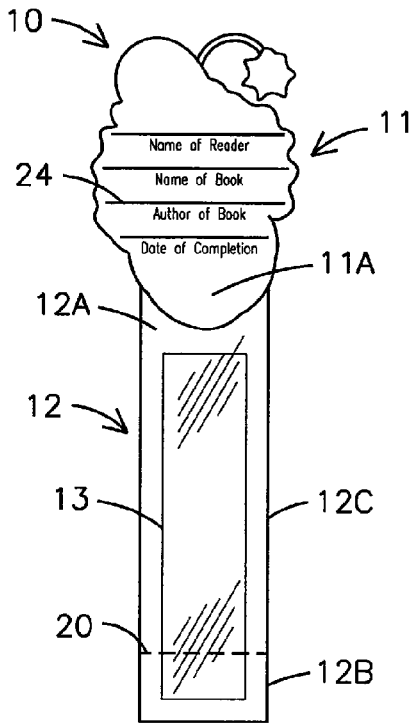
FIG. 2 is a rear elevational view of an embodiment of the bookmark according to the present invention, showing horizontally disposed data fields for entry of historical data relative to the reader and/or book.
Figure 3:
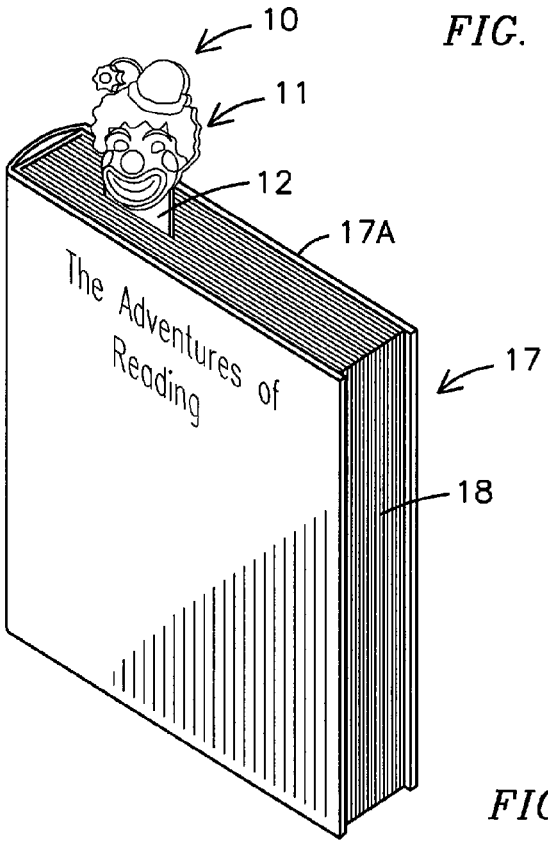
FIG. 3 is a perspective view of a book in which the bookmark according to the present invention is placed.

An embodiment of the invention is illustrated in FIGS. 1, 2 and 3. The bookmark 10 shown in FIG. 1 includes an upper section or tab 11 and a lower pouch 12 for holding an article 13 that is useable for a reader. At least a portion of the pouch 12 is inserted between pages 18 of a book 17. As shown in FIG. 3 at least a portion of the tab 11 extends or protrudes beyond a periphery defined by the outer edges of pages 18 or the outer edge 17A of the book 17 to mark the page or location in a book where a person is reading. The article 13 may take the form of any item that can fit within the compartment 19. For example, the article 13 may include edible items such as gum sticks, taffy, pressed fruit, hard candy or the like or paper items providing game pieces, coupons, promotional pieces, etc. The article 13 is preferably thin and not bulky such that the book cannot be closed when not in use.

With respect to FIGS. 1 and 2, the tab 11 may have an indicia 23 such as fanciful character or design disposed on a first side 11A of the tab 11, and data entry fields 24 disposed on a second side 11B of the tab 11. Alternatively, a character or design may be printed on a separate piece of material, which is adhered to the tab 11. In another embodiment, the tab 11 of the bookmark 10 may include a logo of a manufacturer and/or distributor of the article 13 within the compartment; or, the indicia 23 may be a character or design that has some relevance to the readable item 17 or to the reader.

Figure 4:
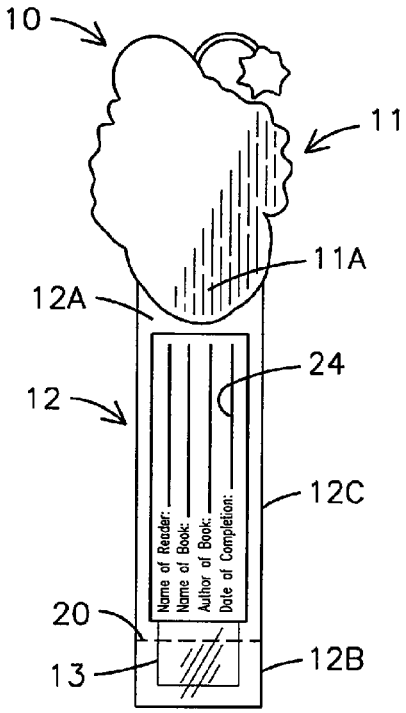
FIG. 4 is a rear elevational view of an embodiment of the bookmark according to the present invention having vertically disposed data entry fields for recording historical data relative to a reader and/or the book.

The data entry fields 24 may be printed directly on the tab 11 (FIG. 2) or the pouch 12 (FIG. 4). Alternatively the data entry fields may be printed on a medium that can be adhered to the tab 11 or pouch 12. The data entry fields 24 provide space to record information about the reader and/or the book, such as name of the reader, the title of the book, and the date the reader completed reading the book. After the reader completes the book, the above referenced information can be recorded on the available space and bookmark 10 or sections 11 and 12 containing the information and stored as a keepsake. After the book is read, the article is removed from the pouch 12. The pouch 12 and tab 11, at this stage, no longer serve the function of a bookmark but are intended to be retained as a keepsake as explained in more detail below.

In an embodiment as mentioned above, the pouch 12 may be formed from available materials such as paper, cellophane, plastics, aluminum used in packaging and is thin enough to tear. Typically, a single sheet of material is folded and sealed at a top end 12A and bottom end 12B, and along a side edge 12C of the pouch 12 forming the compartment 19 therein. In any of the embodiments shown in FIGS. 1 through 7, the tab 11 may be composed of a material that is different than the material making up the pouch 12. For example, tab 11 may be a cardstock paper, cardboard, plastic or any material to which the lower section 12 can be attached.

In any of the embodiments shown in FIGS. 1 through 7, the tab 11 and pouch 12 may be composed of the same materials whereby a seal 25 is formed between the tab 11 and pouch 12. By way of example shrink wrapping, vacuum sealing or heat sealing technology may be used to form the seal 25 between the tab 11 and pouch 12. Heat applied to the tab 11, or an area between the tab 11 and pouch 12 forms the seal 25. The indicia 23 may be printed on the tab 11, or adhered to the tab 11 as a separate part. In the embodiments shown in FIGS. 6 and 7, the tab 11 includes an enlarged background for printing or adding artwork.

Figure 5:
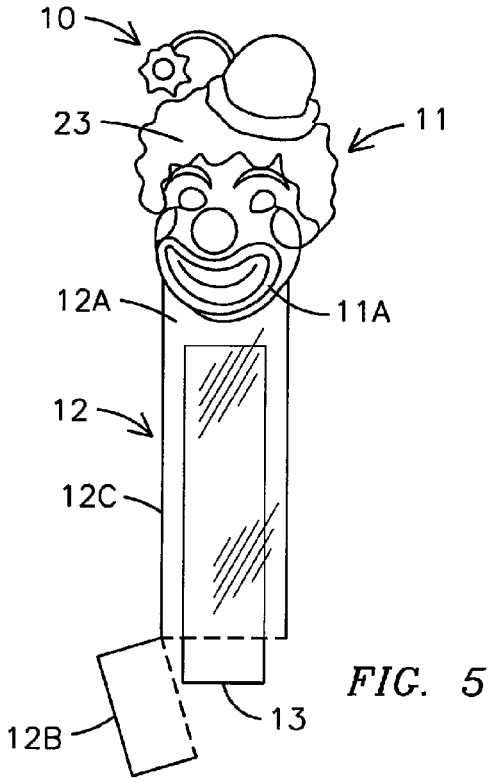
FIG. 5 is a front elevational view of an embodiment of the bookmark according to the present invention having an insert being retrieved from the bookmark.
Figure 6:
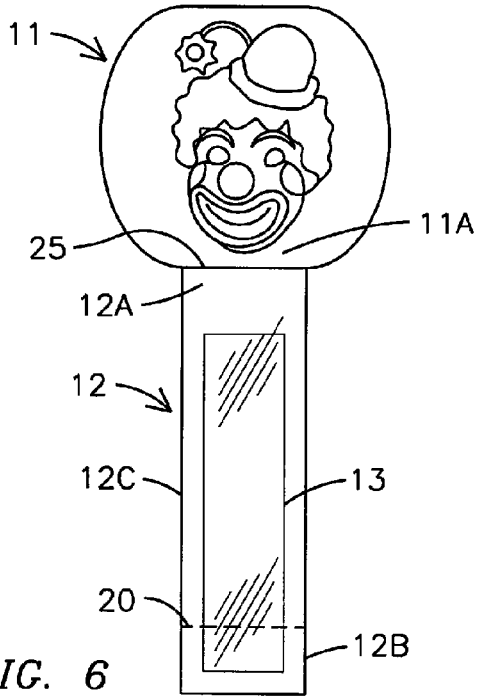
FIG. 6 is a front elevational view of an embodiment of the bookmark according to the present invention with an enlarged oval backdrop as part of the tab.
Figure 7:
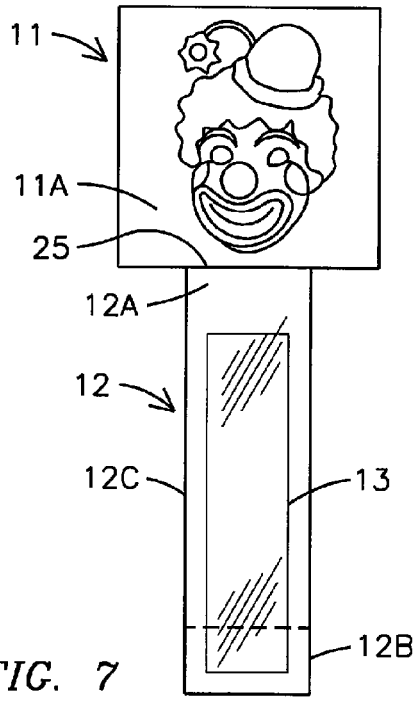
FIG. 7 is a front elevational view of an embodiment of the bookmark according to the present invention with an enlarged rectangular backdrop as part of the tab.

With respect to FIG. 5, the pouch 12 includes a means for opening the pouch 12 or compartment 19 to retrieve the article 13. In an embodiment shown in FIG. 5, a bottom end 12B of the pouch 12 is detachable from a remaining portion of the pouch 12. As shown in FIGS. 1, 2 and 4, the pouch 12 includes a perforation 20 disposed on the pouch 12 distal the tab 11 forming the detachable bottom end 12B. The means for opening the pouch 12 or compartment 19 is not limited to a perforation, but may include other methods or devices that are known to those skilled in the art that form a weakened area along a material to enable one to cleanly open an enclosure, such as a small gap formed in the pouch 12 to initiate a tear.

The invention is ideally suited for children, but not limited to use by children, wherein the bookmark 10 provides a reward for a child reader upon completion of a book 17. As shown in FIG. 4, once a child finishes reading a book the lower section 12 is separated from upper section 11 and/or opened to retrieve the article 13, which may be an edible insert. The lower section 12 and upper section 11 may be disposed of, if the bookmark is of a disposable nature as described above. In the embodiments shown in FIGS. 4 and 7, upper section 11 or lower section 12 have space available for recording the child's accomplishment. For example, the child and/or parent of the child, may record the name of the child, the title of the book and the date the child completed reading the book. The tab 11 and remaining portion of the pouch 12 are retained as a keepsake and no longer useable as a bookmark, thereby provided a historical keepsake having information relative to the reader and/or book.

While the preferred embodiments of the present invention have been shown and described herein, it will be obvious that such embodiments are provided by way of example only and not of limitation. Numerous variations, changes and substitutions will occur to those skilled in the art without departing from the teaching of the present invention. Accordingly, it is intended that the invention be interpreted within the full spirit and scope of the appended claims.

What is claimed is:

1. A bookmark for locating a desired page in a readable item, comprising:

a pouch having a compartment for holding an article for use by a reader of the readable item, the pouch being composed of a material that is torn to access the article, the pouch having a sealed top end and a sealed bottom end, and at least a portion of the pouch is insertable between pages of the readable item to mark a location in the readable item that a user is reading;

a tab having a bottom end that is secured to a top end of the pouch, and at least a portion of the tab protruding from a periphery defined by outside edges of pages of the readable item;

the tab also having a front surface having an indicia thereon and a back surface having one or more data fields for entering data relative to the reader and the readable item; and, wherein the bottom end of the pouch is detached from a remaining portion of the pouch to access the compartment and article.

2. The bookmark of claim 1 wherein the bottom end of the pouch is removed when a reader completes a book and data relative to the reader is entered in the data fields and the tab and pouch no longer serve as a bookmark and the tab and pouch are retained as a keepsake.

3. The bookmark of claim 1 wherein the indicia has a theme relative to the subject matter of the readable item.

4. The bookmark of claim 1 wherein the tab is composed of a material that is more rigid than a material composing the pouch.

5. The bookmark of claim 1 wherein the tab and pouch are composed of the same material and a seal is formed there between.

6. The bookmark of claim 5 wherein a shrink wrap process is used to form the seal.

7. A bookmark for locating a desired page in a readable item, comprising:

a pouch having a compartment for holding an article for use by a reader of the readable item, the pouch being composed of a material capable of the being torn to access the article, the pouch having a sealed top end and a sealed bottom end, and at least a portion of the pouch is insertable between pages of the readable item to mark a location in the item a user is reading;

one or more data fields for entering data relative to the reader on a surface of the pouch;

a tab having a bottom end that is secured to a top end of the pouch, and at least a portion of the tab protruding from a periphery defined by outside edges of pages of the readable item; and, wherein the bottom end of the pouch is detached from a remaining portion of the pouch to access the compartment and article.

8. The bookmark of claim 7 wherein the bottom end of the pouch is removed when a reader completes a book and data relative to the reader is entered in the data fields and the tab and pouch no longer serve as a bookmark and the tab and pouch are retained as a keepsake.

9. The bookmark of claim 8 wherein an indicia is formed on a front surface of the tab and the data entry fields are disposed on a back surface of the pouch relative to the front surface of the tab.

10. The bookmark of claim 7 further comprising a gap formed along a side edge and the bottom end of the pouch to tear the pouch and remove the bottom end of the pouch.

11. The bookmark of claim 10 wherein an indicia formed on a front surface of the tab has a theme relative to the subject matter of the readable item.

12. The bookmark of claim 7 wherein a perforation is disposed on the pouch to tear the pouch and remove the bottom end of the pouch.

13. The bookmark of claim 7 wherein the tab is composed of a material that is more rigid than a material composing the pouch.

14. The bookmark of claim 7 wherein the tab and pouch are composed of the same material and a seal is formed there between.

15. The bookmark of claim 14 wherein a shrink wrap, vacuum seal or heat seal process is used to form the seal.

* * * * *